US007339129B2

(12) United States Patent
Shatley

(10) Patent No.: US 7,339,129 B2
(45) Date of Patent: Mar. 4, 2008

(54) SPRING TO ACTUATOR BEARING MECHANISM

(75) Inventor: George Timothy Shatley, Crumpler, NC (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/428,274

(22) Filed: Jun. 30, 2006

(65) Prior Publication Data

US 2007/0158169 A1 Jul. 12, 2007

Related U.S. Application Data

(60) Provisional application No. 60/696,469, filed on Jul. 1, 2005.

(51) Int. Cl.
*H01H 21/24* (2006.01)

(52) U.S. Cl. ..... 200/339; 200/553; 200/557

(58) Field of Classification Search ..... 200/6 R–6 C, 200/553, 557–563, 339
See application file for complete search history.

(56) References Cited

U.S. PATENT DOCUMENTS 3,172,972 A * 3/1965 Schleicher ..... 200/557
3,290,465 A * 12/1966 Ehrlich ..... 200/559
3,427,418 A * 2/1969 Norden ..... 200/339
3,916,128 A * 10/1975 McLaughlin ..... 200/557
4,074,100 A * 2/1978 Hults et al. ..... 200/339
4,620,071 A * 10/1986 Rushansky ..... 200/68 A
4,740,661 A * 4/1988 Nishikawa et al. ..... 200/563
5,012,495 A * 4/1991 Munroe et al. ..... 337/3
5,391,847 A * 2/1995 Gallone ..... 200/244
6,797,905 B1 * 9/2004 Wang et al. ..... 200/339
6,903,290 B2 * 6/2005 Coppola ..... 200/334
6,903,292 B2 * 6/2005 Balaban et al. ..... 200/339
7,084,360 B2 * 8/2006 Schmidt et al. ..... 200/5 R
7,166,811 B2 * 1/2007 Kontani et al. ..... 200/61.54
7,196,278 B2 * 3/2007 Kurek et al. ..... 200/43.08

* cited by examiner

*Primary Examiner*—Michael Friedhofer
(74) *Attorney, Agent, or Firm*—Paul J. Sutton

(57) ABSTRACT

A plastic actuator for a toggle switch has a metal rod embedded therein, with the metal surface partially exposed. This surface of the metal rod functions as a bearing surface for a positioning spring as the actuator is flipped back and forth to turn the switch on and off. The use of the metal rod to provide a bearing surface in the toggle actuator substantially reduces wear on the actuator, and thus permits the actuator to be made out of a thermoplastic material rather than a thermoset material, thereby effecting a cost savings.

10 Claims, 4 Drawing Sheets

SPRING TO ACTUATOR BEARING MECHANISM

This application claims the benefit of the filing date of a provisional application having application Ser. No. 60/696,469, which was filed on Jul. 1, 2005.

FIELD OF THE INVENTION

This invention relates to electrical switching devices, and more particularly a toggle actuator in a toggle switch.

BACKGROUND OF THE INVENTION

Toggle switches for electrical devices are well known. The actuator portion of a toggle switch is typically made of plastic, and is subject to wear every time the switch is thrown. FIGS. 1-3 are exterior and interior views of a typical toggle lever operated electrical switch 10. A switch body portion 12 contains the switch components which are operated by actuator 15; actuator 15 includes toggle lever 16 extending through a slot in a cover plate 14 which retains the actuator in place and otherwise seals the open top surface of body portion 12. With toggle lever 16 in one position, the switch contacts are separated so that switch 10 is in the OFF position. When the toggle lever 16 is moved to a second position, the switch contacts are made to engage, completing an electrical circuit, so that switch 10 is in the ON position. FIGS. 2 and 3 show the interior of switch body portion 12 in which are placed a stationary spring arm 18 which terminates in a stationary electrical contact 22. Spring arm 18 is integral with plate 20 to which one electrical conductor may be fastened by a terminal screw or the like. A movable spring arm 24 is integral with plate 26 to which a second electrical conductor may be fastened by a terminal screw or the like. Movable spring arm 24 terminates in a movable contact 28. In the position shown in FIGS. 2 and 3, switch 10 is in the ON position; contacts 22 and 28 are engaged and the electrical circuit is closed, permitting current to flow between contacts 22 and 28.

As shown in FIG. 3, the actuator 15 has a short cylindrical shaft 32 on each side, only one of which is visible in FIG. 3, which engages notches 30 on the interior of the rear wall 40 (shown in FIG. 2) and the interior of the front wall. The actuator 15 is held in place by cover plate 14 which retains each of the shafts 32 in a corresponding notch 30 and permits the shafts 32 to rotate within the notch 30. Extending from the bottom of actuator 15 is a cam 50, which engages movable spring arm 24 as the toggle lever is moved from the ON position to the OFF position and causes the movable spring are 24 to move downwardly towards the bottom wall 42 of switch body portion 12. This action separates the contacts 22 and 28 and opens the electrical circuit. When the toggle lever is moved from the OFF position to the ON position, as shown in FIG. 3, the movable spring arm 24 is free to move the movable contact 28 into engagement with stationary contact 22.

An extension 52 extends from the bottom of actuator 15; the bottom end of extension 52 receives thereabout a positioning spring 56, the other end of which is positioned in a recess 54 in bottom wall 42. Extension 52, recess 54 and spring 56 provide an over-center retaining mechanism to retain toggle lever 16 in each of two distinct positions.

Extension 52 is generally formed integrally with actuator 15, and is constantly in contact with spring 56. In order to prevent rapid wear of the extension at the bearing surface (that is, where the extension contacts the spring), the entire actuator is typically made of a durable nonconducting material (e.g. thermosetting plastic). There is a need for a toggle switch actuator that can be produced at lower cost while still being resistant to wear at the bearing surfaces.

SUMMARY OF THE INVENTION

The present invention addresses the above-described need by providing a toggle switch including an actuator and a coil spring. The actuator, which is rotatably mounted in a switch body, includes an actuator body portion and a bearing surface portion; the actuator body portion and the bearing surface portion are of different materials. The coil spring has a first end and a second end; the first end surrounds an end portion of the actuator body portion while making contact with the actuator only at the bearing surface portion. The second end is positioned in a recess formed in the switch body. The end portion and the spring form a retaining mechanism for the actuator. Rotation of the actuator (such as movement of the toggle lever between the ON and OFF positions) causes the bearing surface portion to pivot relative to the spring.

In a particular embodiment of the invention, a plastic actuator for a toggle switch has a metal rod which is embedded in the actuator, with the metal surface of the rod partially exposed. This metal surface functions as a bearing surface for a positioning spring as the actuator is flipped back and forth to turn the switch on and off. The use of the metal rod as a bearing surface in the toggle actuator substantially reduces wear on the actuator, and thus permits the actuator to be made out of a thermoplastic material rather than a thermoset material, thereby effecting a cost savings.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claims, and the accompanying drawings in which similar elements are given similar reference numerals:

DETAILED DESCRIPTION OF EMBODIMENTS OF THE INVENTION

Figure 1:
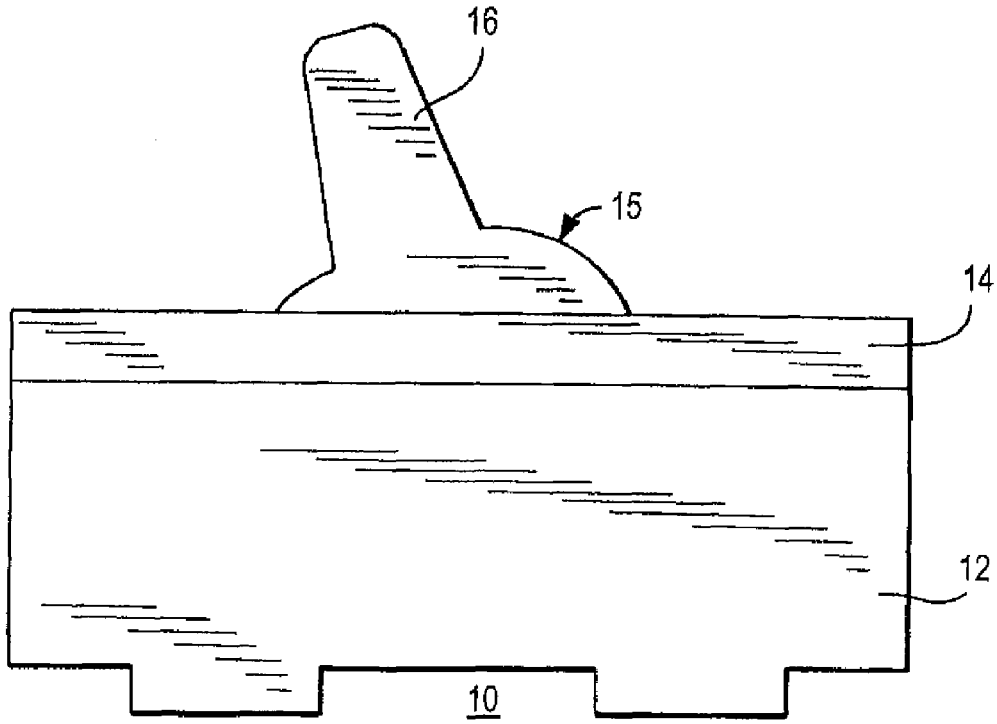
FIG. 1 illustrates the exterior of a typical toggle lever operated electrical switch.
Figure 2:
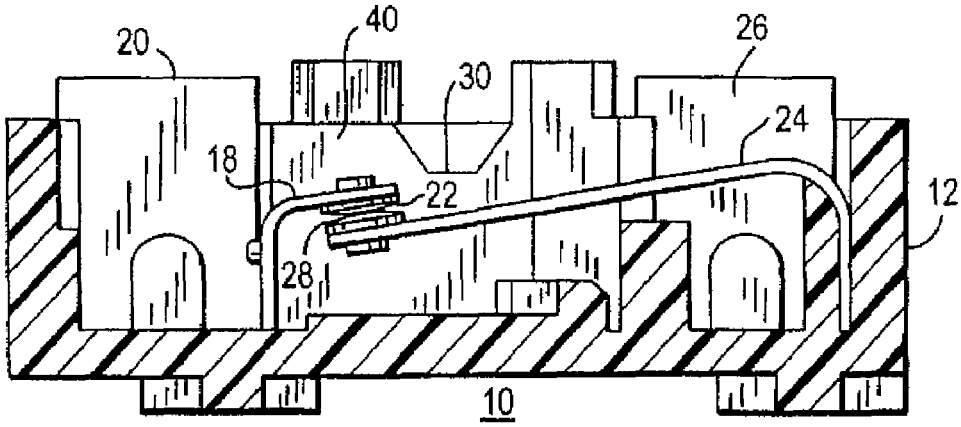
FIG. 2 PRIOR ART
FIG. 2 is a cross-sectional view of the interior of a typical toggle switch, showing a spring arm for closing and opening contacts in an electrical circuit.
Figure 3:
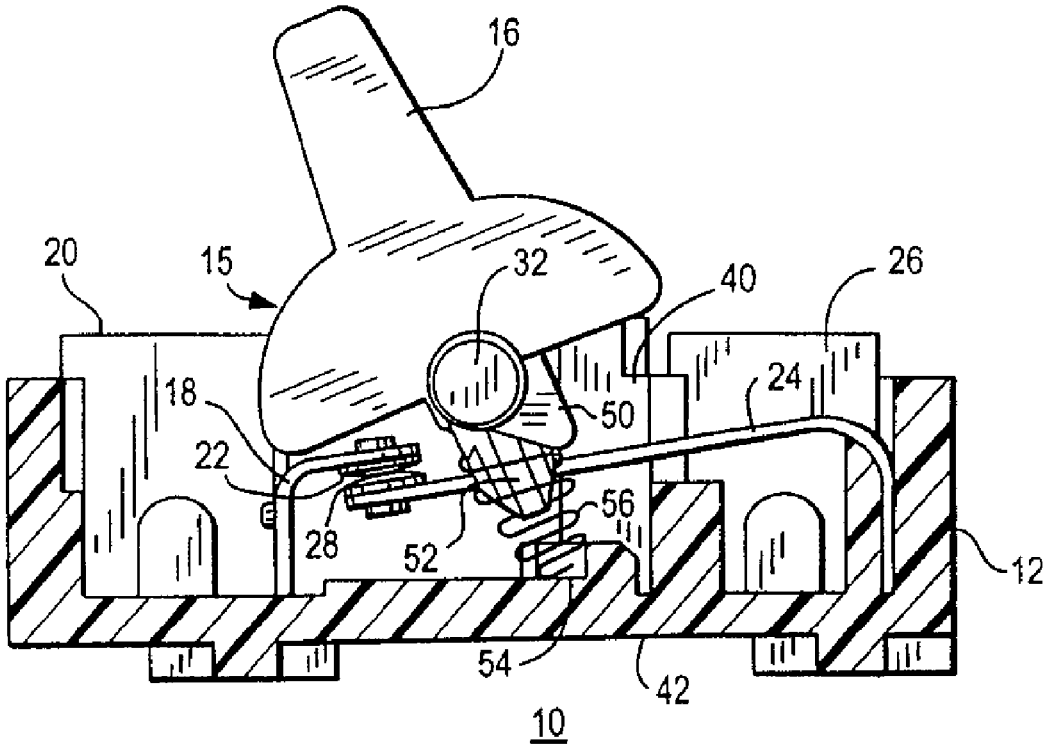
FIG. 3 PRIOR ART
FIG. 3 is another cross-sectional view of the interior of a typical toggle switch, showing how motion of the toggle lever opens an electrical circuit.
Figure 5:
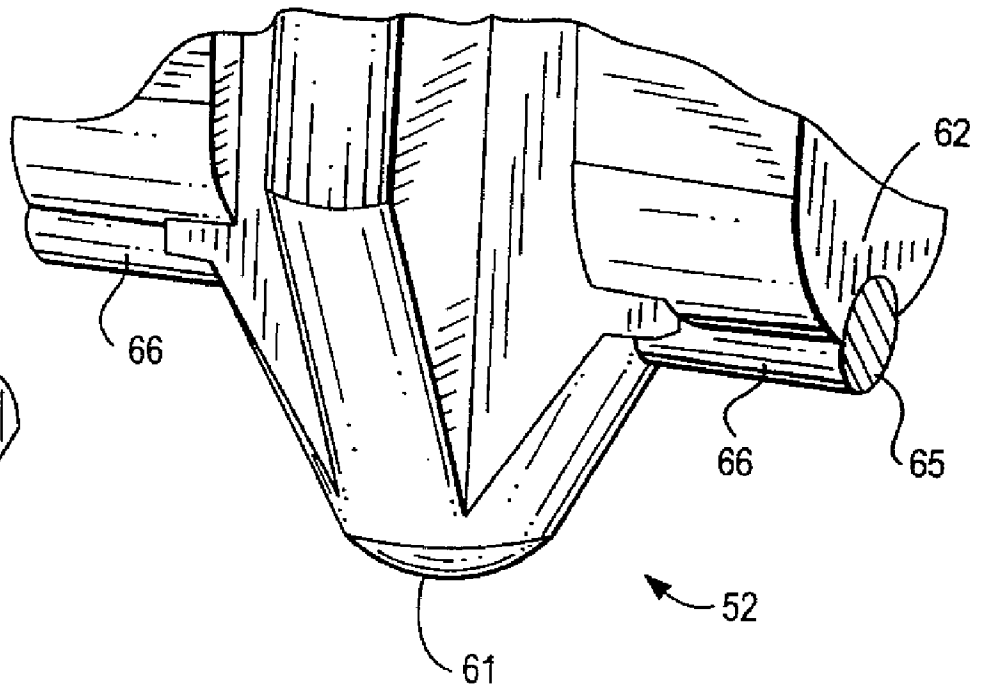
FIG. 5 is a detail view of FIG. 4, showing a metal rod embedded in the actuator in accordance with an embodiment of the invention.
Figure 4:
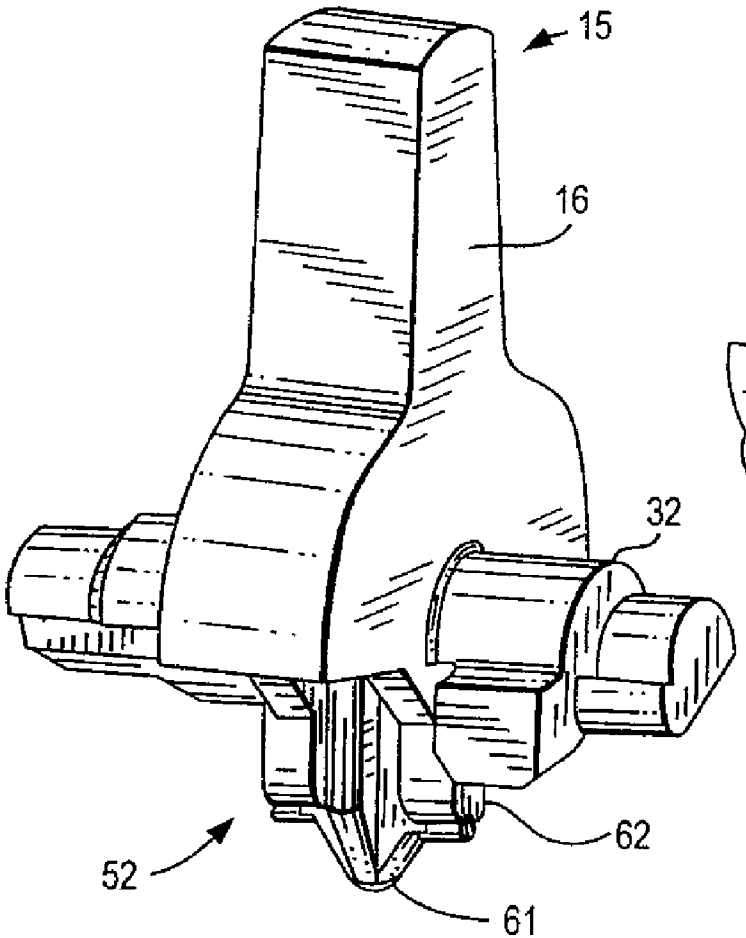
FIG. 4 shows a switch toggle actuator with a metal rod providing bearing surfaces, in accordance with an embodiment of the invention.

FIG. 4 shows a toggle switch actuator 15 in accordance with an embodiment of the invention. Extension 52 extends downward from the body of actuator 15. The bottom end portion 61 of extension 52 is generally conically shaped, and is sized so as to fit inside a spring (not shown). Extension 52 also includes arms 62 generally parallel with shafts 32; the bottom surfaces of arms 62 bear against the spring which surrounds bottom end portion 61. In this embodiment (as best shown in detail FIG. 5), a metal rod 65 is embedded in actuator 15 while being partially exposed at the bottom of arms 62. Each bearing surface 66 of the actuator is thus an approximately half-cylindrical metal surface.

Figure 7:
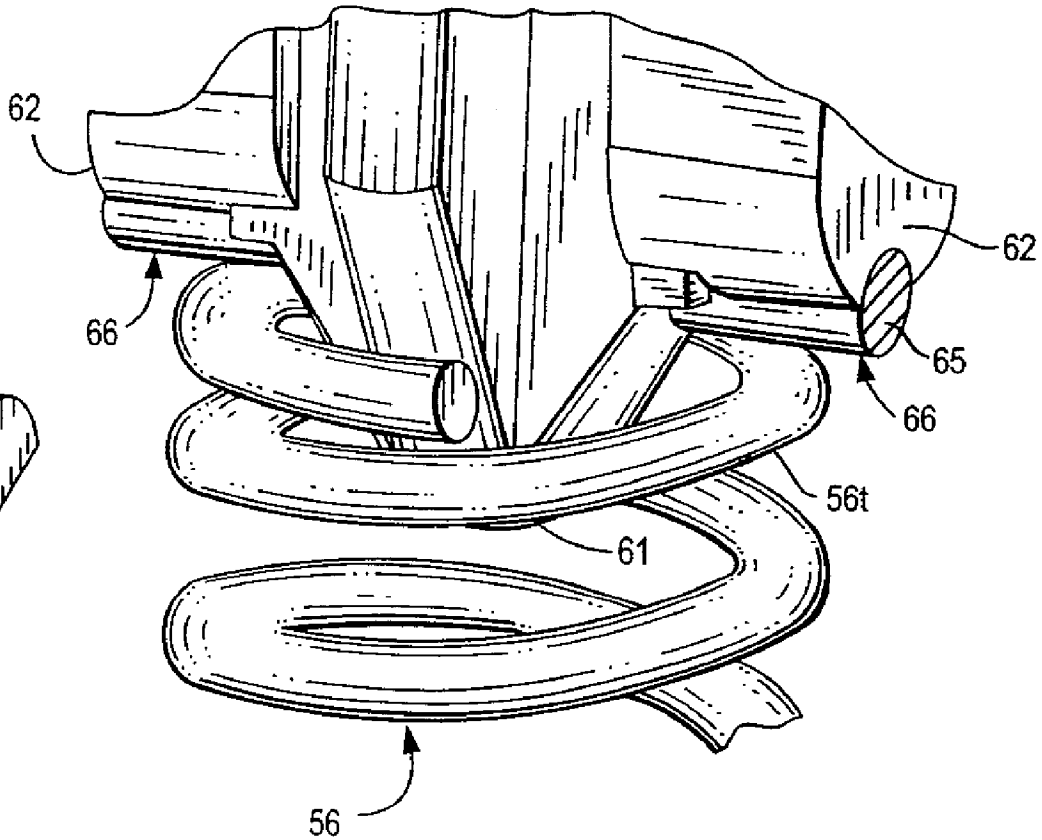
FIG. 7 is a detail view of FIG. 6, showing surfaces of a metal rod bearing against the spring, in accordance with an embodiment of the invention.
Figure 6:
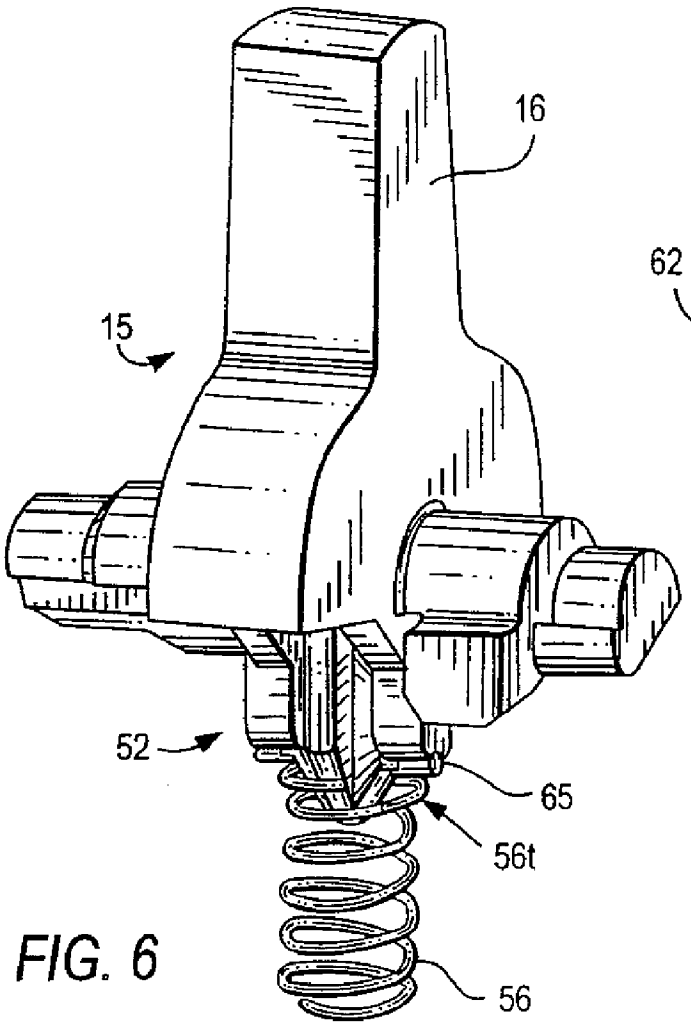
FIG. 6 shows the switch toggle actuator of FIG. 4 engaged with a spring, in accordance with an embodiment of the invention.

FIG. 6 shows the actuator of FIG. 4 engaging coil spring 56. The top coil 56*t* of the spring bears against metal rod 65 embedded in the actuator (more clearly shown in detail FIG. 7). As shown in FIG. 7, each bearing surface 66 (on the undersides of arms 62, one on each side of extension 52) has a point of contact with spring coil 56*t*. In operation, as toggle lever 16 is moved between the ON position and the OFF position, actuator 15 rocks back and forth so that metal rod 65 pivots against coil 56*t*. The contact between the actuator and the spring is thus a metal-to-metal contact at all times, instead of a metal-to-plastic contact as in a conventional switch. Accordingly, wear of the plastic actuator material at the bearing surfaces is avoided, so that the body of the actuator may be made of a lower-cost material such as a thermoplastic.

While the invention has been shown and described in terms of specific embodiments, it is evident in view of the foregoing description that numerous alternatives, modifications and variations of the form and details of the invention and in its operation may be made by those skilled in the art, without departing from the spirit of the invention. Accordingly, the invention is intended to encompass all such alternatives, modifications and variations which fall within the scope and spirit of the invention and the following claims.

I claim:

1. A toggle switch comprising:

a coil spring disposed in a switch body; and an actuator rotatably mounted in the switch body, said actuator including an actuator body and a bearing surface comprising a metal rod embedded in said actuator body and having a partially exposed surface, wherein the actuator makes contact with the spring only at the bearing surface, the bearing surface is continuously in contact with the spring, and the actuator body and the bearing surface are of different materials.

2. A toggle switch according to claim 1, wherein said spring makes contact with the bearing surface at two locations on an end coil thereof.

3. A toggle switch according to claim 2, wherein rotation of the actuator causes the bearing surface to pivot relative to said spring.

4. A toggle switch according to claim 2, wherein the actuator body portion includes an end and the spring surrounds the end.

5. A toggle switch according to claim 4, wherein the spring has a first end and a second end, the first end including the end coil making contact with the bearing surface and the second end making contact with the switch body, the actuator body end and the spring forming a retaining mechanism for the actuator.

6. A toggle switch according to claim 4, wherein the actuator body is of thermoplastic material.

7. A toggle switch comprising:

an actuator rotatably mounted in a switch body, said actuator including an actuator body and a bearing surface, the actuator body and the bearing surface being of different materials; and a coil spring having a first end and a second end, the first end surrounding an end of the actuator body and making contact with the actuator only at the bearing surface, the second end making contact with the switch body, the end and the spring forming a retaining mechanism for the actuator, wherein the bearing surface is a metal rod embedded in the actuator body and having a partially exposed surface for making contact with the spring, and the bearing surface is continuously in contact with the spring.

8. A toggle switch according to claim 7, wherein the actuator body is of thermoplastic material.

9. A toggle switch according to claim 7, wherein rotation of the actuator causes the bearing surface to pivot relative to the spring.

10. A toggle switch comprising:

a body member having a front wall and a back wall spaced apart and substantially parallel to said front wall, a first end wall and a second end wall spaced apart and substantially parallel to said first end wall and a bottom wall, said front wall, said back wall, and said first end wall and said second end wall joined to said bottom wall to form a rectangular body member open at the top and with a central cavity therein;

a toggle actuator of plastic rotatably mounted upon said front wall and said back wall, within said central cavity, said toggle actuator including a toggle lever;

a stationary contact mounted to said body member;

a movable contact mounted to said body member and engageable by said toggle actuator to move into contact away from contact with said stationary contact in accordance with movement of the toggle lever;

a coil spring positioned to engage the lower end of said toggle actuator; and a metal rod embedded in the lower end of said toggle actuator and positioned to contact said coil spring, wherein said metal rod forms a bearing surface with said coil spring, the toggle actuator is in contact with the spring only at the bearing surface, and the bearing surface is continuously in contact with the spring.

* * * * *